United States Patent [19]

Thomson

[11] 4,162,074

[45] Jul. 24, 1979

[54] GOLF PUTTER

[76] Inventor: William B. Thomson, 9132 Gettysburg Dr., Huntington Beach, Calif. 92646

[21] Appl. No.: 761,164

[22] Filed: Jan. 21, 1977

Related U.S. Application Data

[63] Continuation-in-part of Ser. No. 716,603, Aug. 23, 1976, abandoned.

[51] Int. Cl.[2] ..... A63B 53/04

[52] U.S. Cl. ..... 273/175

[58] Field of Search ..... 273/77 R, 78, 167–175; 34/5 GH, 5 GC

[56] References Cited

U.S. PATENT DOCUMENTS

| | | | |
|---|---|---|---|
| 2,665,909 | 1/1954 | Wilson | 273/175 X |
| 3,989,256 | 11/1976 | Cicero | 273/167 J |
| 3,989,257 | 11/1976 | Barr | 273/175 |
| 4,077,633 | 3/1978 | Studen | 273/175 X |

FOREIGN PATENT DOCUMENTS

| | | | |
|---|---|---|---|
| 27807 | of 1912 | United Kingdom | 273/175 |
| 637948 | 5/1950 | United Kingdom | 273/175 |

*Primary Examiner*—Richard J. Apley

*Attorney, Agent, or Firm*—Knobbe, Martens, Olson, Hubbard & Bear

[57] ABSTRACT

A golf putter has on its face a convex, parabolic protruding portion extending horizontally along the face at a height such as to strike a golf ball slightly below its center. The convex protuberance provides only a very slight lift to the ball and imparts a substantial amount of overspin.

6 Claims; 5 Drawing Figures

FIG. 1.
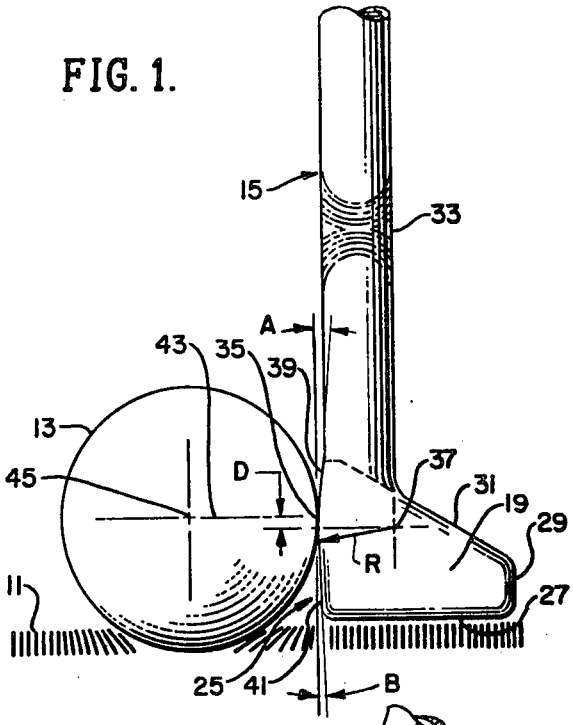
FIG. 2.
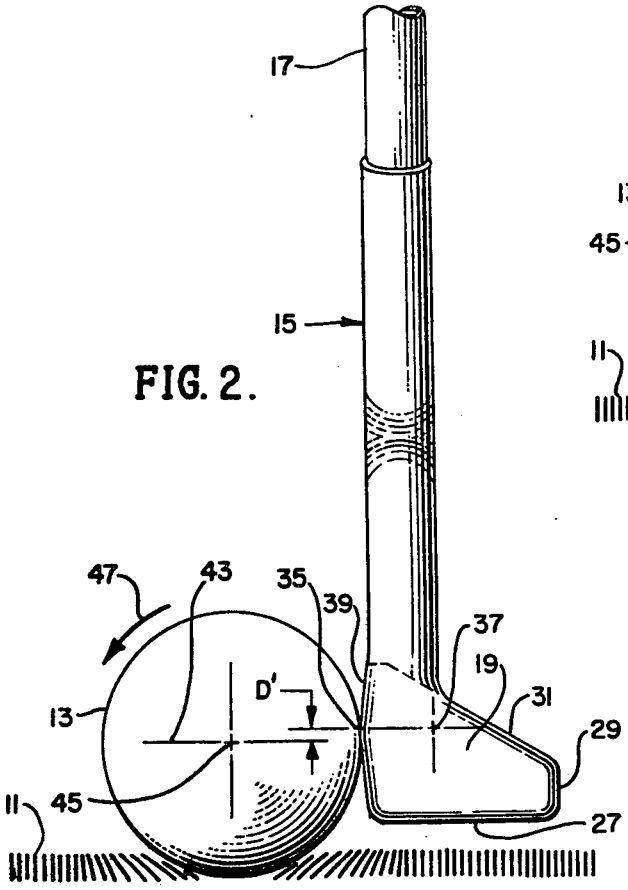
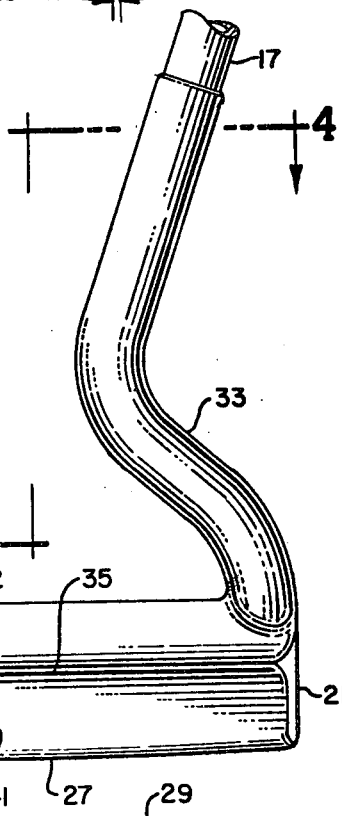
FIG. 3.
FIG. 4.
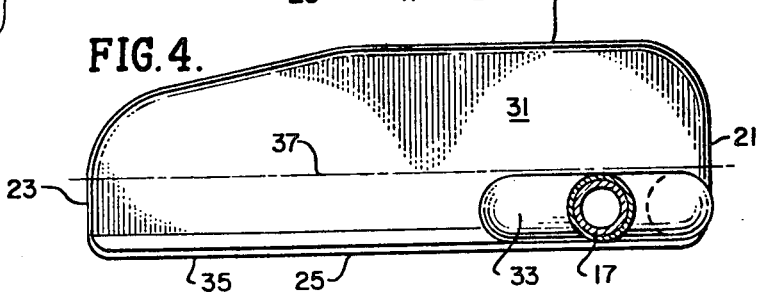
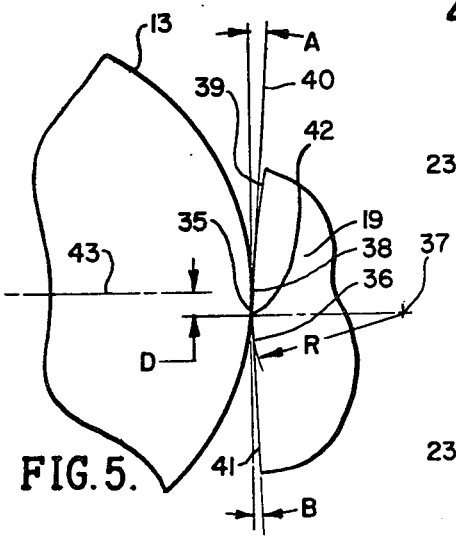
FIG. 5.

GOLF PUTTER

RELATED APPLICATIONS

This application is a continuation-in-part of application Ser. No. 716,603, filed Aug. 23, 1976, entitled GOLF PUTTER, now abandoned.

BACKGROUND AND SUMMARY OF THE INVENTION

Two competing characteristics are desirable in a golf putting stroke. First, some lift must be imparted to the golf ball to cause it to rise slightly out of the grass on the putting surface and begin its travel toward the hole with a minimum likelihood of initial deflection from the blades of grass on which it rests. The second desirable factor of said stroke is the induction of topspin to the ball in order to cause said ball to roll in a straight line course with minimum deviation resulting from its contact with the putting surface.

The putter of this invention achieves a unique combination of those two desirable characteristics with a putter which has satisfactory balance and instills confidence on the part of the golfer. Accordingly, this invention provides an elongate convex, parabolic protuberance which extends along the forward face of the putter head with its apex at a predetermined height designed to contact a golf ball only slightly below its center. By contacting the ball below center, the protuberance imparts a minimal lifting force to the ball as it is set in motion. The protuberance is convex at all sections from the heel of the putter to its toe. As the golfer continues the swing of his putting stroke, which naturally causes the putter head to elevate from the ground, the bottom portion of the parabolic surface of the putter face rides up on the ball and imparts topspin. The convex section preferably approximates an exponential curve or parabola. The convex is very slight, however, to avoid too much lift or too much operspin on a poor stroke.

BRIEF DESCRIPTION OF THE DRAWING VIEWS

FIG. 1 is an end elevation view showing the putter head as it makes initial contact with the golf ball;

FIG. 2 is a view similar to FIG. 1 but showing the putter head and ball shortly after initial contact;

FIG. 3 is a front elevation view of the putter head;

FIG. 4 is a top plan view of the putter head; and

FIG. 5 is an enlarged partial end elevation view illustrating the relationship of the putter head and the ball in the area of contact.

DESCRIPTION OF A PREFERRED EMBODIMENT

Referring to FIGS. 1, 3 and 4, a typical golf putting or "green" surface 11 is shown comprising very low cut grass on which rests a golf ball 13 used in play of the game of golf in a well-known manner. A putter 15 includes a shaft 17 extending generally upright to be gripped by the golfer at the upper end (not shown) and a head 19 at the bottom of the shaft. The head 19 has a heel end 21 which faces toward the golfer and a toe end 23 which faces away from the golfer. The face 25 of the putter head 19 is used to contact the ball 13. The bottom or sole 27 of the putter head 19 is shown as flat from front to back, and slightly convex from heel to toe. The back 29 is shown as a vertical surface much shorter than the face 25 and the top 31 is shown as inclined from the face 25 to the back 29. The shaft 17 is inserted in or otherwise attached to the gooseneck shaped hosel area 33. Other shapes for the top, sole, back, and shaft are contemplated within the scope of this invention which relates primarily to improvements in the face.

The face 25 of the putter head 19 includes an elongate convex protuberance or striking surface 35 which extends further forward than any other portion of the face 25 so as to make contact with the golf ball 13. The convex striking surface 35 preferably extends uniformly substantially along the entire length of the putter face 25 from heel 21 to toe 23, although it need not extend beyond the area of contact with ball 13.

Referring primarily to FIGS. 1, 4, and 5, the convex striking surface 35 preferably is a complex curve which can be called generally parabolic or exponential in section. FIGS. 1 and 5 show the shape of the face viewed along a horizontal axis 37 perpendicular to the intended path of the ball. The section of the face includes a central arcuate portion 35 formed on a radius R around a horizontal axis 37 extending parallel to the face 25 and perpendicular to the intended stroke of the putter. A lower surface 41 below the striking surface 35 is tangent to the arc 35 at 36 and slopes back from the vertical at an angle B. This lower surface 41 may be flat. An upper surface 39 above the striking surface 35 begins at a point 38 where a tangent 40 to the arc 35 is at an angle to the vertical of A. This upper surface 39 is not flat, but instead is rounded back slightly from the tangent 40 in a flat generally exponential or parabolic curve which diverges slightly from the tangent 40. For convenience this complex curve can best be referred to as parabolic.

Referring primarily to FIGS. 1 and 4, the leading portion of the striking surface 35 as the putter 15 is stroked to the left in FIG. 1, is the apex 42, i.e. the portion in the same horizontal plane as the axis 37. This is intentionally designed to be just a slight dimension D below the horizontal plane 43 passing through the center 45 of the golf ball 13 when the ball 13 is at rest. Thus, the initial contact of the putter face 25 on the ball 13 is slightly below center on the ball 13 so as to impart some slight lift to the ball 13 as it is put in motion. Too much lift, however, would tend to give the ball 13 an undesirable backspin, so the dimension D preferably is kept quite small. FIG. 5 illustrates this concept with the enlarged fragmentary view as shown.

Referring now to FIG. 2, as the golfer continues his putting stroke, the putter head 19 lifts as it moves forward because the golfer normally strokes the putter 15, more or less, in an arc about his wrists or his upper torso depending upon his individual stroking style. As the putter head 19 moves forward, it remains in contact with the ball 13 for a very short distance. As shown in FIG. 2 the convex striking surface 35 rises above the center 45 of the ball 13 a distance D'. Friction between the convex striking surface 35 and convex surface of the ball 13 thus causes the putter face 25 to impart topspin, or rotation in the direction of the arrow 47, to the ball 13 such as one friction pulley turns another.

In practice it has been found that a dimension of about 0.700 inches for the radius R is preferable for the convex striking surface 35. A radius R which is too small tends to give a "harder" feel to the golfer as it strikes the ball 13 since contact is made along a sharper edge at 35. This effect would become quite noticeable at a radius below about 0.650 inches. A radius R which is too large approaches the effect of a planar surface and will give too much lift if the golfer holds his hands too far behind the ball in addressing the ball or will force the ball down into the ground if the golfer's hands are too far forward. These effects may become a problem, for example, with a radius above 0.750. The radius R also affects the amount of topspin in the direction 47 imparted to the ball 13.

It has been found in practice that the desired combination of some, but minimum, lift and ample overspin is achieved if the axis of curvature 37 is about 0.10 inches below the center 45 of the ball 13 at contact. This distance is shown at D in FIGS. 1 and 5. Golf balls complying with the rules of the U.S. Golf Association are 0.837 inches in radius. A golf ball normally settles in the closely mowed grass of a green enough so that a typical golfer will stroke the ball with the putter sole about 0.10–0.15 inches above the bottom of the ball. Thus, typically the axis of curvature 37 would be about 0.60 above the sole 27 of the putter head 19. As different golfers may stroke slightly higher or lower relative to the grass on the putting "green" 11 this dimension might be varied for different golfers, but about 0.60 is believed to be a suitable dimension for most conditions.

Preferably the angle B is about 2°. At that angle the lower tangent point 36 is low enough on the face that the lower flat face 41 never contacts the ball even with the overriding effect as shown in FIG. 2. This angle is not critical within limits, so long as it is large enough to permit the arcuate portion 35 to remain in contact with the ball throughout the follow-through, and yet is small enough that if the golfer incorrectly strikes the ball much too high, so that the flat face 41 makes the initial contact, the ball will not be pinched sharply into the ground resulting in an erratic putt. An angle of less than about 1° for B would severely limit the extent of the arcuate portion 35, while an angle of over about 4° or 5° would increase the bad effect of a very high stroke.

The angle A is more critical as it affects the initial contact with the ball. For this reason an angle A of 3° is preferred. Less than about 2° generally would provide significantly less initial loft to the ball, whereas an angle A of over about 4° would unduly emphasize lift at the expense of overspin.

Moreover, as noted above the upper face 39 is not flat but is rounded slightly back from the tangent 40. This preferably is accomplished by rounding the upper face 39 to blend from the 0.700 radius at the tangent point 38 to a curve of about 42 inch radius at the upper edge 42 of the face. This slight rounding leaves the upper face 41 at about the 3° angle to the vertical, but provides a smooth transition from the arcuate face 35 and has been found to give the preferred "feel" in "popping" the ball up from the putting surface while still achieving the desired overspin.

Of course, each of the dimensions specified above can be varied within reasonable limits, but the ranges specified above have been given to provide an indication of the order of magnitude of the limits.

What is claimed is:

1. In a golf putter having a shaft and a head, an improved face on one side of the head for stroking a golf ball, comprising:

an elongate face surface;

an elongate convex striking surface protruding forwardly from said face surface, and extending generally horizontal therealong;

the extreme forward apex portion of said convex striking surface being disposed only slightly below the center of a standard size golf ball when the ball and head are resting on a typical putting surface on which the club is designed to be used and also when the putter head is held slightly above the putting surface; and said convex surface having a generally arcuate portion of about 0.7 inches radius at said apex and transitioning to an upper surface generally tangent to said arcuate surface and disposed at about 3° to the vertical.

2. A golf putter in accordance with claim 1 wherein said upper surface is slightly rounded to a very flat parabolic shape.

3. A golf putter in accordance with claim 1 wherein the dimension from the bottom surface of the head to the axis of curvature is about 0.6 inches.

4. A golf putter in accordance with claim 1 wherein the axis of curvature is located about 0.10 inches below the center of the ball when putting with a normal stroke.

5. A golf putter in accordance with claim 1 wherein said face portion below said striking surface is a generally planar surface, generally tangent to the arc of said striking surface, and disposed at an angle of about 2° to the vertical.

6. A golf putter in accordance with claim 1 wherein said convex striking surface extends substantially across the entire length of the putter face.

* * * * *